US008616882B2

(12) United States Patent
Chedid et al.

(10) Patent No.: US 8,616,882 B2
(45) Date of Patent: Dec. 31, 2013

(54) METHOD AND DEVICE FOR DETECTING A FIRE SHOT EVENT IN A WEAPON

(75) Inventors: Michel Chedid, Jönköping (SE); Mats Forselius, Jönköping (SE); Stefan Dahlqvist, Tenhult (SE); Anders Isaksson, Ulricehamn (SE); Ingemar Emricson, Bankeryd (SE)

(73) Assignee: SAAB AB, Linköping (SE)

( * ) Notice: Subject to any disclaimer, the term of this patent is extended or adjusted under 35 U.S.C. 154(b) by 366 days.

(21) Appl. No.: 12/673,597

(22) PCT Filed: Jul. 8, 2008

(86) PCT No.: PCT/EP2008/058825

§ 371 (c)(1),
(2), (4) Date: Jun. 29, 2011

(87) PCT Pub. No.: WO2009/021781

PCT Pub. Date: Feb. 19, 2009

(65) Prior Publication Data

US 2011/0252683 A1 Oct. 20, 2011

(30) Foreign Application Priority Data

Aug. 16, 2007 (EP) ..... 07114404

(51) Int. Cl.
*F41G 3/26* (2006.01)

(52) U.S. Cl.
USPC ..... 434/19; 434/11

(58) Field of Classification Search
USPC ..... 434/11–27; 42/104–105, 107–108, 42/111–147
See application file for complete search history.

(56) References Cited

U.S. PATENT DOCUMENTS

| | | | | |
|---|---|---|---|---|
| 3,938,262 | A | 2/1976 | Dye et al. | |
| 4,768,958 | A | 9/1988 | Suddaby | |
| 6,616,452 | B2 * | 9/2003 | Clark et al. | 434/19 |
| 2004/0036602 | A1 | 2/2004 | Lerg | |
| 2004/0137411 | A1 * | 7/2004 | Kemp et al. | 434/11 |

FOREIGN PATENT DOCUMENTS

| | | | |
|---|---|---|---|
| EP | 0302663 | A | 2/1989 |
| WO | WO-2004/070309 | A | 8/2004 |

OTHER PUBLICATIONS

PCT/ISA/210—International Search Report—Dec. 15, 2008.
PCT/ISA/237—Written Opinion of the International Searching Authority—Dec. 15, 2008.
PCT/IPEA/409—International Preliminary Report on Patentability—Oct. 22, 2009.

* cited by examiner

*Primary Examiner* — Timothy A Musselman
(74) *Attorney, Agent, or Firm* — Venable LLP; Eric J. Franklin

(57) ABSTRACT

A method including measuring a physical quantity having a magnitude that changes in time as a result of a fire shot event so as to obtain a measurement signal, and comparing the measurement signal with a predetermined time-domain fingerprint for said quantity, which fingerprint is characteristic of the way the quantity varies in time upon a fire shot event, in order to confirm the occurrence of a fire shot event in case the measurement signal and the fingerprint match.

9 Claims, 5 Drawing Sheets

METHOD AND DEVICE FOR DETECTING A FIRE SHOT EVENT IN A WEAPON

CROSS-REFERENCE TO RELATED APPLICATIONS

This application claims priority to European patent application 07114404.2 filed 16 Aug. 2007 and is the national phase under 35 U.S.C. §371 of PCT/EP2008/058825 filed 8 Jul. 2008.

TECHNICAL FIELD

The invention relates to a method for detecting a fire shot event in a weapon, a shot detection device, and a computer program product.

BACKGROUND ART

Laser-based shooting simulation systems for small arms are commonly used in both civil applications such as tactics and shooting games, and in gunnery and skills training for military trainees. The firearm simulators used in such systems emulate fire shots by sending a light beam, such as a laser beam, of short duration when they are triggered by a user.

To make the military training realistic, and to take soldiers as close to the experience of firing live rounds as possible, real firearms using blank cartridges are often used as such firearm simulators. Thereby, the military trainees experience the sound, the burst and the visual impression of real combat equipment, bringing them as close as possible to a true shooting sensation. In this case, a laser unit, often referred to as a "simulator", is detachably connected to the barrel of the firearm for generating a laser beam when the firearm is triggered. Modern laser units, such as the Small Arms Transmitter (SAT) from Saab Training Systems, are also often arranged to communicate wirelessly with an information collection unit carried by each participant of the laser-based military training exercise. All firing events may then be transmitted to the information collection unit and can subsequently be used during exercise evaluation.

In order to determine when the laser beam shall be generated, the fire shot event, i.e. the event of a user activating the triggering mechanism of the firearm, has to be detected by the laser unit. Normally, the occurrence of a fire shot event is established by determining when the explosion caused by the blank cartridge has taken place. There are mainly three detection principles used in the art for establishing the occurrence of such an explosion: flame detection, sound detection, and shock detection.

The principle of flame detection utilizes the muzzle flame generated by the exploded cartridge to detect the fire shot event. By equipping the laser unit with an IR sensor that measures the intensity of the flame, the laser unit can establish that a fire shot event has taken place in case the measured intensity value exceeds a predetermined threshold value.

The principle of sound detection utilizes the sound generated by the explosion of a cartridge to detect the fire shot event. The laser unit may in this case be equipped with a microphone and if the sound level registered by the microphone exceeds a predefined limit, a fire shot event is assumed to have taken place.

The principle of shock detection utilizes the shock caused by the exploded cartridge to detect the fire shot event. By measuring the acceleration of the firearm caused by the exploded cartridge with an accelerometer disposed in the laser unit, a fire shot event can be established if the acceleration of the firearm exceeds a predefined value.

All three of the above principles hence use an absolute limit for a measured physical quantity and when the signal measured by a suitable sensor in the laser unit exceeds said limit, the occurrence of a fire shot event in the firearm is "proved" and the laser unit generates a laser beam emulating a fire shot.

All the detection principles explained above suffer from drawbacks.

For example, there is training ammunition which does not cause any muzzle flame when fired. This renders the flame detection principle useless. Furthermore, shooting in cold weather decreases the intensity of the muzzle flame making the flame detection principle uncertain. Although the sound detection principle and the shock detection principle may be used with non-flame generating ammunition, these principles are also prone to errors resulting in high false detection rate. When using the sound detection principle, it is hard to determine whether a sonic boom is caused by the explosion of a blank cartridge in a particular firearm, or caused by something else in the immediate surroundings of said firearm. As a result, a fire shot event may be falsely detected and a laser beam generated by a laser unit mounted on a firearm in the proximity of, e.g., another firearm being fired. The high false detection rate when using the shock detection principle is due to the fact that the firearm is often exerted to heavy acceleration whenever it is bumped against something. Each time the acceleration registered by the accelerometer in the laser unit exceeds the predefined threshold value, the bump will erroneously be considered as a fire shot event in the firearm and a laser beam will be generated. During military training exercises, the firearm is often subject to rough handling, leading to frequent detection of such false fire shot events.

Furthermore, all the above detection principles invite the military trainees to "cheat" during military exercises. When using the flame or sound detection principle the military trainees can fool the laser unit to produce a laser beam by simply directing a light emitting or sound producing device towards the pertinent sensor of the shot detection device. Each time the intensity of the emitted light or the produced sound exceeds the predetermined threshold value the laser unit generates a laser beam. Thereby, the military trainees obtain an endless supply of "ammunition". When using the shock detection principle, the same is achieved by bumping the firearm against any accessible object, or simply tapping the laser unit.

To make cheating more difficult and to provide a more robust detection, two or all of the above detection principles are often combined. This, however, makes the laser unit bigger, more power consuming and more expensive.

SUMMARY OF THE INVENTION

It is an object of the present invention to provide a fire shot event detection principle which minimizes the risk of erroneously detected fire shot events, and which can be employed to detect fire shot events when using non-flame generating ammunition.

This object is achieved by a method for detecting a fire shot event in a weapon comprising the step of measuring a physical quantity whose magnitude changes in time as a result of a fire shot event, and the step of comparing the measurement signal to a predefined time-domain fingerprint for said quantity, which fingerprint is characteristic of the way said quantity varies in time upon a fire shot event, in order to confirm the occurrence of a fire shot event in case said measurement signal and said fingerprint match.

By measuring a physical quantity that varies in time as a result of a fire shot event and comparing the measurement signal to a predefined characteristic signature or fingerprint in the time domain, the method according to the present invention greatly reduces the risk of falsely detecting a fire shot event compared to prior art methods.

According to a preferred embodiment of the invention, the physical quantity measured is the shock or vibration of a weapon caused by the explosion of a cartridge, which explosion is caused by a user activating the triggering mechanism of the weapon.

By utilizing the shock or vibration of the weapon for detecting a fire shot event, the preferred embodiment of the present invention is able to determine when a fire shot event has occurred even when using non-flame generating ammunition.

According to another embodiment of the invention, the physical quantity measured is the pressure wave in air caused by the explosion of a cartridge.

According to yet another embodiment of the invention, the physical quantity measured is the electromagnetic wave or pulse caused by the explosion of a cartridge.

According to still another embodiment of the invention, the physical quantity measured is the radiance or light intensity of the muzzle flash caused by the explosion of certain types of cartridges.

Preferably, both the measurement signal and the predefined time-domain fingerprint are represented by vectors s and U, respectively, and the comparison is based on the difference between said vectors.

By representing both the measurement signal and the predefined signature or fingerprint by vectors, the step of comparing the two in order to detect a fire shot event is fast, requires low computational power, and thus low energy consumption.

Preferably, the step of comparing the measurement signal with the predefined fingerprint comprises the steps of:

forming an error estimation E as a weighted sum of absolute differences according to $E=W^T|U-s|$, where W is a weight vector, U is a vector representation of the predefined fingerprint and s is a vector representation of the measurement signal; and computing E continuously with an online algorithm where the computation is made on a moving window of the same length as the fingerprint vector U in order to confirm the occurrence of a fire shot event in case E drops below a predefined threshold value T.

According to one embodiment of the present invention, the fingerprint vector U is determined as the mean of a plurality of measurement signals caused by a fire shot event in the weapon according to $$U = \frac{1}{N}\sum_n u^n$$

$$n = 1 \ldots N$$

where $u^n$ is the $n^{th}$ measurement signal vector and N is the number of measurements performed, and the weight vector W is approximated as $$W = \frac{1}{\sigma(u^n)}$$

$$n = 1 \ldots N$$

where $u^n$ is the $n^{th}$ fingerprint measurement vector, N is the number of fingerprint measurements, and $\sigma(u^n)$ is the standard deviation for the fingerprint measurements.

According to other embodiments of the present invention, the measurement signal and the predefined time-domain signature or fingerprint can be compared by means of a curve adaptation procedure or an image recognition procedure.

DETAILED DESCRIPTION

Figure 1:
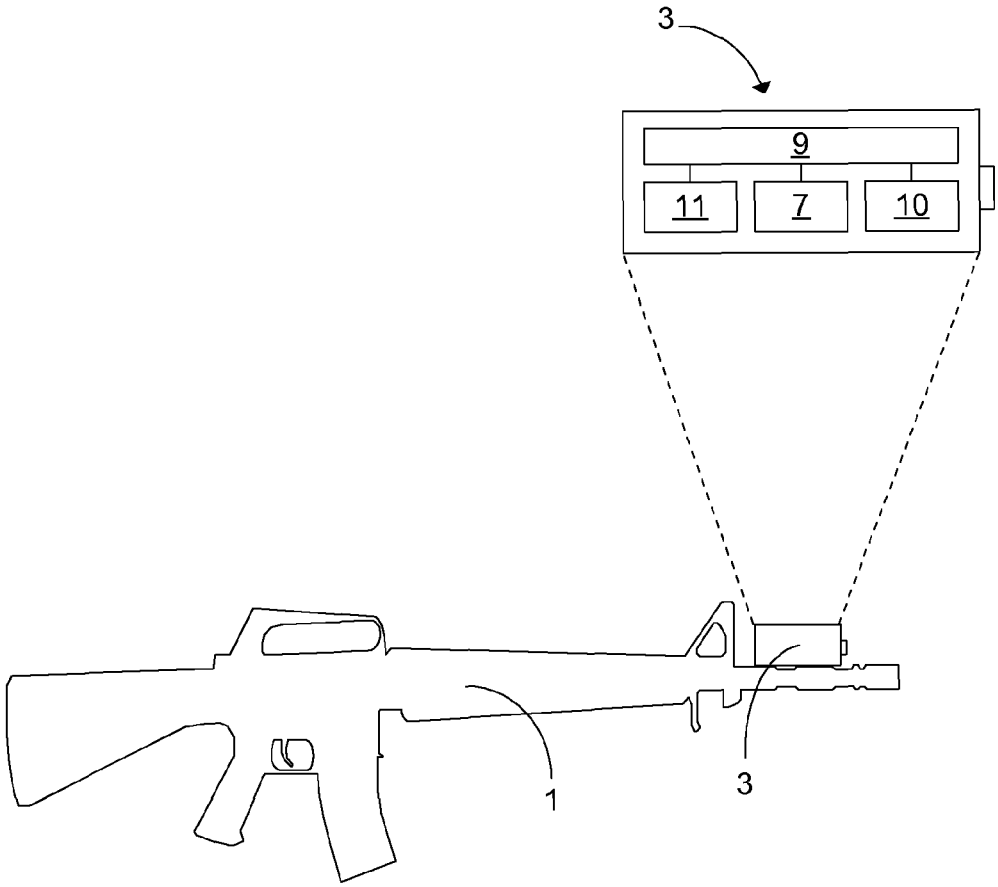
FIG. 1 illustrates a weapon to which a shot detection device according to the present invention is detachably connected.

FIG. 1 illustrates a weapon 1 to which a shot detection device 3 according to the invention is mounted in order to determine when the weapon 1 is fired.

In this embodiment, the shot detection device 3 is detachably connected to the barrel of a real M16 firearm 1. However, it should be appreciated that the detection principle according to the invention is applicable to detect firing of a shot by any weapon; from small arms and shoulder launched anti-armour weapons, to the guns of main battle tanks and helicopters.

The shot detection device 3 comprises measuring means 7 for measuring a physical quantity whose magnitude changes in time as a result of a fire shot event in the firearm 1. For example, the measuring means 7 may be an accelerometer and the physical quantity measured may be the shock or vibration of the firearm 1. The shot detection device 3 further comprises comparison means 9 arranged to receive measurement signals from the measuring means 7, and to compare said signals to a predetermined time-domain "fingerprint" for said quantity. A fingerprint, also referred to as "signature", should in this context be construed as a predetermined time-domain signal indicating how a particular physical quantity changes in time as a result of a fire shot event in a weapon. The signature or fingerprint can thus be regarded as a time-varying pattern for a physical quantity caused by a fire shot event. The comparison means 9 comprises storage means (not shown) for storing said signature or fingerprint signal, and logic circuits (not shown), such as a CPU, for carrying out the signal comparison procedure. Additionally, the shot detection device 3 may also comprise a laser beam generating unit 10 for generating a laser beam when the firearm 1 is fired. In this case, the comparison means 9 is communicatively connected to the laser beam generating unit 10 in order to send a signal indicating that a laser beam should be generated in case the measurement signal received from the measuring means 7 matches said predefined signature or fingerprint. Preferably, the comparison means 9 is also connected to a communication unit 11 which is arranged to transmit information relating to the comparison procedure conducted by the comparison means 9, such as confirmed fire shot events, to an information collection device (not shown) which, e.g., may be carried by the user of the firearm in order to evaluate the military training exercise later on. Normally, such information collection devices are also arranged to keep track of which type of weapon the user carries, the number of bullets fired by the user, and/or the status of the user with whom it is associated (e.g. if the user is "dead" or "alive"). The communication means 11 of the shot detection device 3 and the information collection device may also be adapted for bi-directional communication. This makes it possible to "lock" a certain weapon, i.e. to render impossible firing thereof, if certain conditions are met, e.g. if the user of said weapon is "dead". Preferably, information is sent wirelessly between the two units in order to allow the user to move freely.

Figure 2:
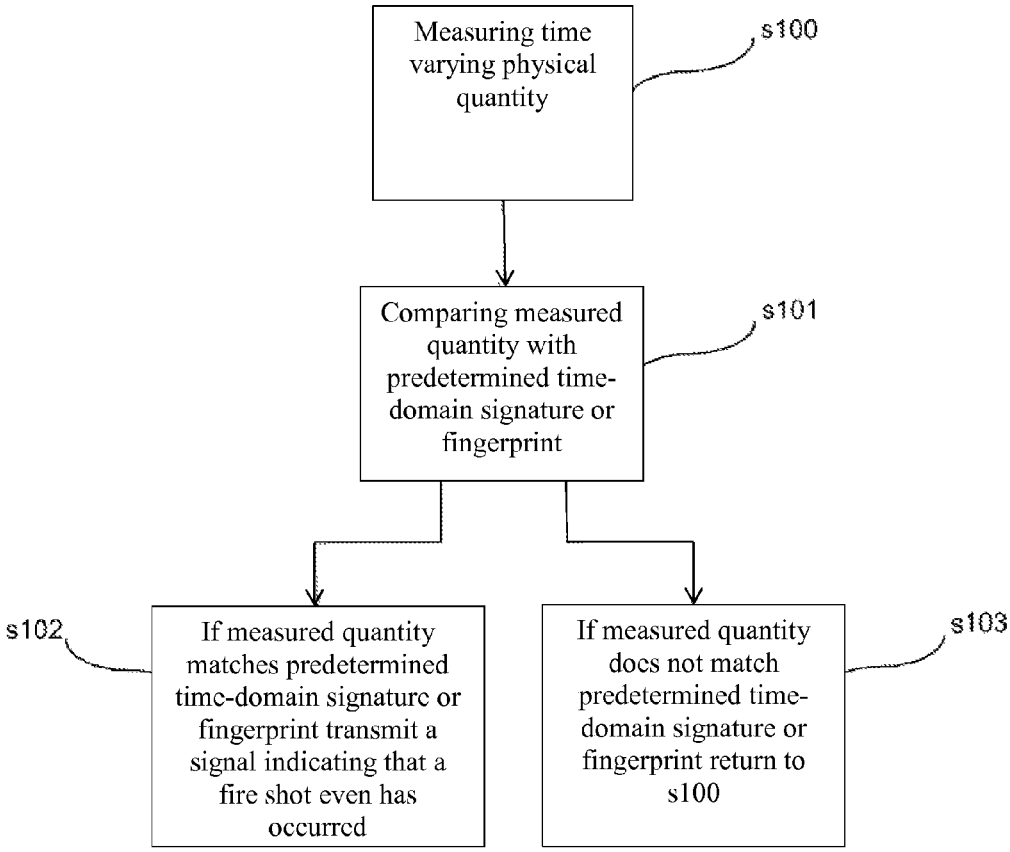
FIG. 2 shows a flowchart illustrating a method for detecting a fire shot event in a weapon according to the present invention.

FIG. 2 shows a flowchart illustrating a method for detecting a fire shot event in a weapon according to the present invention. The method will be described in a context in which the establishment of a fire shot event is reported to an information collection device for evaluation purposes and used to generate a laser beam emulating a fire shot from the weapon. However, it should be appreciated that detection of a fire shot event in a weapon can be useful for other purposes and that the fire shot event detection principle according to the invention is not limited to this particular field of application. For example, it can be used to detect fire shot events in firearms using live rounds. Then the step of generating a laser beam is unnecessary but the invention can still serve the purpose of reporting fire shot event data to an information collection device for later evaluation.

When explaining the flowchart in FIG. 2, reference will also be made to the weapon 1 and the shot detection device 3 and all of its components illustrated in FIG. 1.

In step s100, the measuring means 7 measures a physical quantity whose magnitude changes in time as a result of a fire shot event in the weapon 1. The physical quantity may be any quantity that is affected by the firing of the weapon in a way that is characteristic for a fire shot event. One example of such a physical quantity is the shock or vibration of the weapon caused by the explosion of a blank cartridge, which will be further described below. The measurement signal is then transmitted to the comparison means 9 and the method proceeds to step s101.

In step s101 the comparison means 9 compares the measurement signal to a predefined time-domain signature or fingerprint for the particular quantity measured. The comparison may be continuously performed by the comparison means 9 but preferably, in order to minimize energy consumption in the shot detection device 3, the comparison procedure is carried out only when the magnitude of the measured quantity exceeds a predetermined threshold value. If the measurement signal matches the predetermined signature or fingerprint, a fire shot event has most likely occurred in the weapon and the method proceeds to step s102. If, on the other hand, there is no match between the measurement signal and the predetermined signature or fingerprint, the increased magnitude of the particular physical quantity (which increase triggered the comparison procedure) was caused by something else than a fire shot event in the weapon and the method proceeds to step s103.

In step s102, the comparison means 9 transmits a signal indicating that a fire shot event has taken place to the laser beam generating unit 10 and the communication means 11. As response thereto, the laser beam generating unit 10 generates a laser beam emulating a fire shot, and the communication means 9 transmits a signal indicating that the weapon with which the shot detection device 3 is associated has been fired to an information collection device gathering information of the firearm and the user carrying it, as explained above.

Step s103 is, as mentioned above, only carried out in case the measurement signal does not match the predefined signature or fingerprint, i.e. when a signal indicative of a potential fire shot event has been received by the comparison unit 9 but was found out to originate from something else than a fire shot event in the weapon. In this case, the method may simply return to step s100, or, if desirable, the comparison means may be arranged to send a signal to the communication means 11 indicating that a "false fire shot event" has been detected. In the latter case, the communication means 11 may forward this information, and also the characteristics of the measured false signal, to an information collection device for further evaluation.

Thus, instead of registering a fire shot event as soon as the measured physical quantity exceeds a predetermined threshold value, as known in the art, the method according to the present invention does not register a fire shot event unless the change of said quantity in time follows a certain pattern (i.e. matches the signature or fingerprint) which is characteristic of a fire shot event. This step of comparing the measurement signals measured by the measuring means 7 to a predefined time-domain signature or fingerprint being indicative of a fire shot event ensures a high degree of certainty in fire shot event detection. The method of detecting a fire shot event in a weapon according to the present invention thus minimizes the false detection rate and makes it very hard for a user to "fool" the logic of the shot detection device so as to generate laser beams although being out of ammunition.

The present invention is not limited by the way the physical quantity is measured, the way the time-domain signature or fingerprint for said quantity is determined, or the way the comparison between the measurement signals and the signature/fingerprint is carried out. However, these aspects will now be discussed below with reference made to FIGS. 3, 4 and 5.

Figure 3:
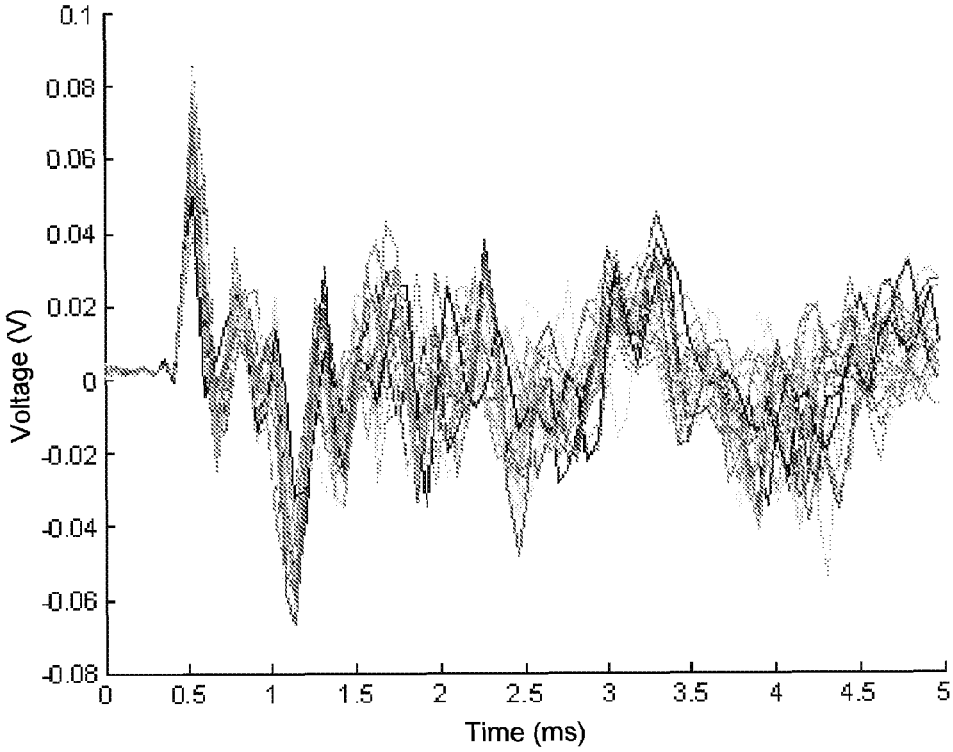
FIG. 3 illustrates shock measurement signals resulting from fire shot events in an M16 firearm.
Figure 4:
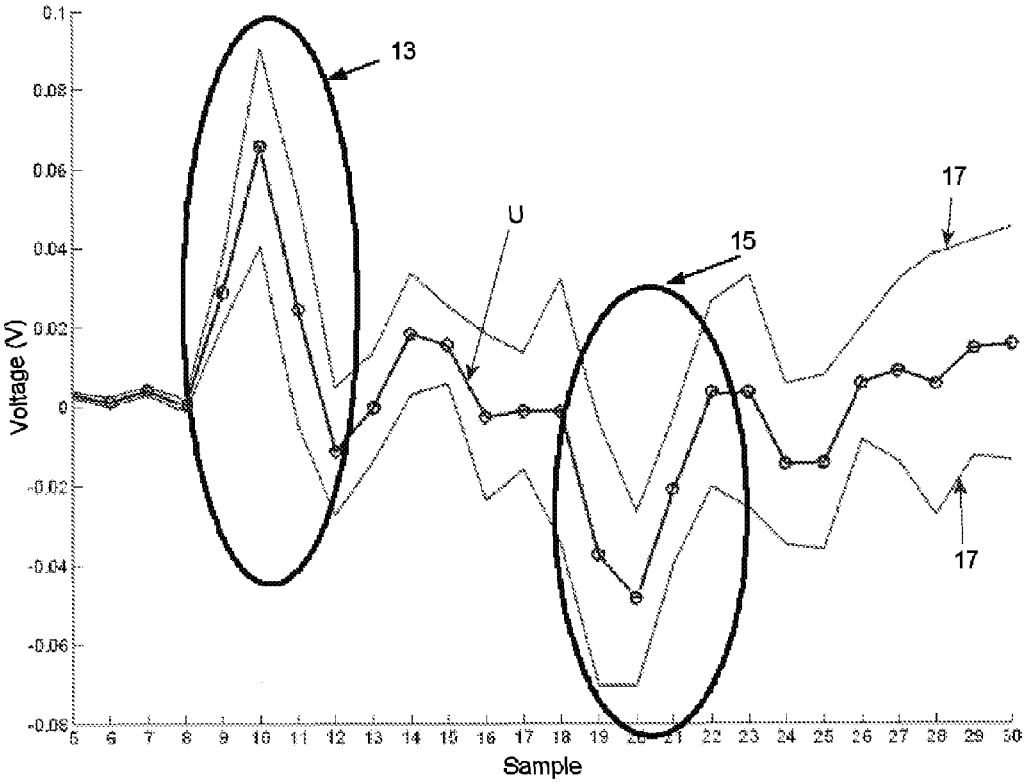
FIG. 4 illustrates a time-domain shock signature, or shock fingerprint, U, of an M16 firearm, plotted together with a 95% confidence interval.

With reference first made to FIGS. 3 and 4, a way of determining a time-domain shock signature or fingerprint for a weapon will be explained. Although the shock or vibration of the weapon caused by the explosion of a blank cartridge is used in this particular case, a person skilled in the art will recognize that the same principles are applicable to any physical quantity whose magnitude changes in time as a result of a fire shot event in a weapon. It is thus appreciated that the fire shot detection method disclosed herein is not limited to any particular physical quantity.

In FIG. 3, shock measurement signals measured by an accelerometer and resulting from fire shot events in an M16 firearm are shown. During the measurement procedure, the accelerometer was included in a shot detection device, such as the shot detection device 3 illustrated in FIG. 1, which was detachably attached to the barrel of the M16 firearm. Each measurement signal from the accelerometer was low-pass filtered at a cut-off frequency of 8 kHz and sampled with an analog-to-digital converter (ADC). The samples were obtained with a sampling period of 10 μs and then down-sampled to a sampling period of 60 μs μs. As seen in the figure, the first sequence (from approximately 0.4 to 1.2 ms) of each shock signal represents a repetitive signal with high confidence, and due to the good agreement between the different signal measurements within this time-window, these portions of the signals can be used to determine a shock signature or fingerprint for the M16, and hence be used for detecting a fire shot event in such a firearm. Henceforth, these shock signal measurements from which the shock signature or fingerprint is determined, as further described below, will be referred to as the fingerprint measurements. The sampled fingerprint measurement signals may be represented by fingerprint measurement vectors $u^n$.

With reference now made to FIG. 4, a time-domain shock signature, or shock fingerprint, U, of an M16 firearm is shown. The shock fingerprint, U, has been determined based on the repetitive portions of the fingerprint measurements shown in FIG. 3, i.e. the portions within the above mentioned time-window. The first part 13 represents the event of the firearm striker hitting the primer causing a forward acceleration. This is followed by a time period during which the gunpowder is burning, until an explosion takes place pushing the firearm bolt backward which can be seen in the shock fingerprint as a backward acceleration 15.

Preferably, the fingerprint, U, is determined by computing the mean for all fingerprint measurements. That is, the shock signature or fingerprint can be represented by a signature or fingerprint vector, U, according to $$U = \frac{1}{N}\sum_{n} u^n \qquad n = 1 \ldots N \qquad \text{Equation (1)}$$

where $u^n$ is the $n^{th}$ fingerprint measurement vector and N is the number of fingerprint measurements. In FIG. 4, the shock signature or fingerprint, U, is plotted together with a 95% confidence interval 17.

Having calculated the signature or fingerprint vector, U, it can be stored in the comparison unit 9 described above with reference to FIGS. 1 and 2. By sampling and processing the measurement signal measured by the accelerometer according to the fingerprint measurements (i.e. the measurement signals shown in FIG. 3), a measurement vector, s, is generated. The comparison between the measurement signal and the predetermined signature or fingerprint is then performed by computing the error, or difference, between the measurement vector, s, and the fingerprint vector, U. The comparison algorithm used by the comparison means 9 is preferably an online algorithm where the computation is made on a moving window of the same length as the signature or fingerprint vector, U. The error estimation, E, is preferably a weighted sum of absolute differences according to the following equation:

$$E = W^T|U - s| \qquad \text{Equation (2)}$$

where W is a weight vector, U is the predefined fingerprint vector and s is the measurement vector. The weight vector W determines how much each sample point should influence the final outcome of the error estimation, and can thus be chosen to attach great importance to parts of the fingerprint vector being truly characteristic of a fire shot event, and less importance to parts of the fingerprint vector from which the measurement vector may differ slightly although the measurement vector represents a true fire shot event. Therefore, the weight vector W is preferably approximated as the inverse of the standard deviation, σ, for the fingerprint vector, which standard deviation is a vector whose elements indicate the standard deviation for the fingerprint measurement vectors $u^n$ from the fingerprint vector U at each sample point. That is, the values of the standard deviation vector are a measure of the correspondence between the fingerprint measurements signals at each sample point. The weight vector may hence be given by:

$$W = \frac{1}{\sigma(u^n)} \qquad n = 1 \ldots N \qquad \text{Equation (3)}$$

where N is the number of fingerprint measurements, u, on which the fingerprint vector, U, is based.

Thus, the comparison means 9 may be arranged to compare the sampled and processed measurement signal represented by a vector s to the predetermined fingerprint vector, U, and to calculate the error estimate, E, on a moving window of the same length as the fingerprint vector U. When the error estimate E drops below a certain threshold value T, a match between the measurement signal and the predetermined fingerprint has been established, indicating that a fire shot event in the firearm has been detected. The threshold value T is chosen in dependence of the demand on the fire shot detection rate for the firearm, i.e. the probability of detecting a true fire shot event, as will be described below.

Figure 5:
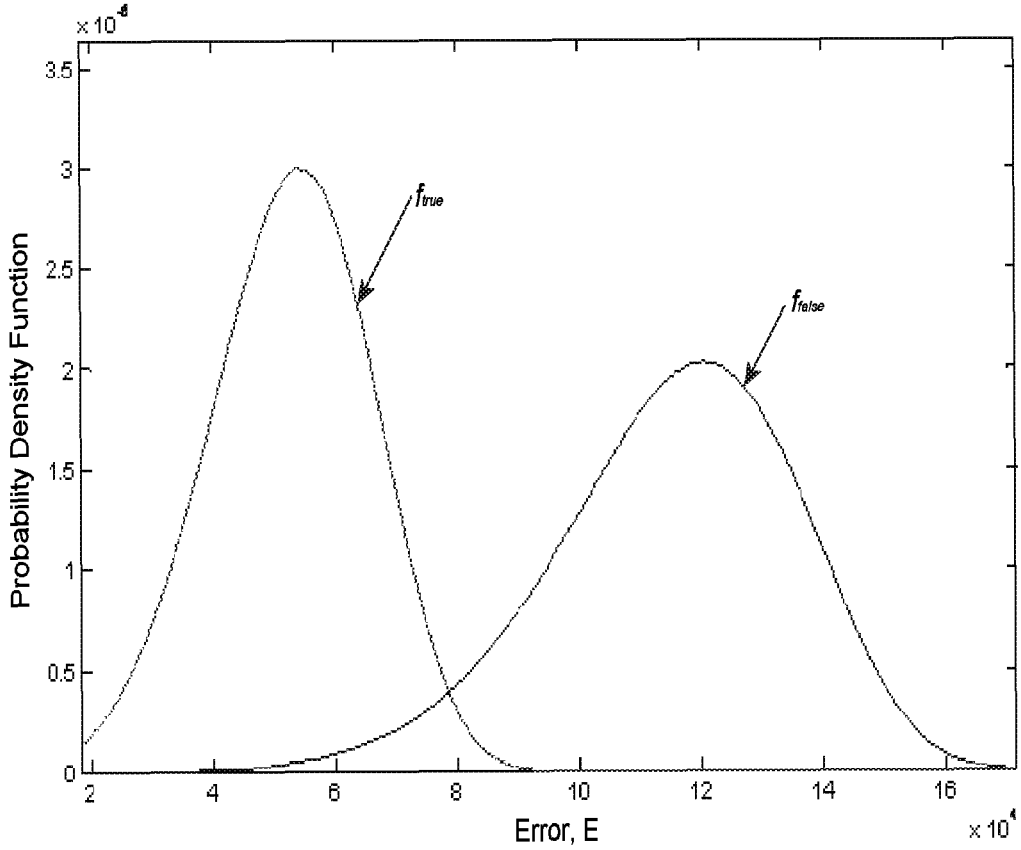
FIG. 5 illustrates the probability distribution functions for the event of detecting a true fire shot event in a weapon and the event of detecting a false fire shot event in a weapon under certain circumstances.

First, the error estimation, E, for several measurement signals representing both "true" and "false" fire shot events is calculated. Here, a "false" fire shot event is a non-fire shot event causing a change of the studied physical quantity in time. By specifying the detection rate requirement of the shot detection device, e.g. 95%, two Weibull statistical distributions, $f_{true}(x)$ and $f_{false}(x)$ can be fitted to each type of error, as is shown in FIG. 5. T can then be calculated by solving the following equation:

$$\int_0^T f_{true}(x)\,dx \geq 0.95 \qquad \text{Equation (4)}$$

When T has been calculated using Equation 4, the false detection rate or false alarm rate, i.e. the probability of detecting a false fire shot event, $p_{false}$, is given by:

$$p_{false} = \int_0^T f_{false}(x)\,dx \qquad \text{Equation (5)}$$

As seen in FIG. 5, the choice of the threshold value T for the error estimate, E, is a balance between maximizing the possibility of detecting a true fire shot event and minimizing the risk of detecting false fire shot events. If the correspondence between the shock measurement signals caused by false fire shot events (e.g. the event of the firearm bumping into a rock or the soldier carrying it) and the predefined shock fingerprint is low, the statistical distribution $f_{false}$ will be located further to the right in FIG. 5 and the overlap between $f_{true}$ and $f_{false}$ will be insignificant. The same effect is achieved if the correspondence is high between the measurement signals caused by a true fire shot event and the predefined shock fingerprint, in which case the statistical distribution $f_{true}$ will be narrower. That is, the more characteristic the change of the measured quantity in time is of a fire shot event, and the less similar the change of the measured quantity in time is to the change of said quantity in time caused by other events than fire shot events, the more reliable is the fire shot event detection method according to the present invention.

Above it has been shown that a time-domain signature or fingerprint based on the mean of the fingerprint measurements is acceptable to distinguish true fire shot events from false fire shot events. However, according to a refined embodiment of the present invention, an optimal fingerprint vector, $\hat{U}$, and an optimal weight vector, $\hat{W}$, can be determined from a set of measurement signals caused by both true and false fire shot events. This optimization of the fingerprint and weight vector increases the performance of the detection algorithm by increasing the signal-to-noise ratio. The optimal vectors $\hat{U}$ and $\hat{W}$ are determined as described below.

Let the fingerprint measurement vectors be denoted by:
$u^n$ n=1 . . . N
and an error measurement vectors by:
$e^m$ m=1 . . . M
Then the optimal fingerprint vector $\hat{U}$ and the optimal weight vector $\hat{W}$ is determined by solving the following respective equation:

$$\hat{U} = \underset{U}{\operatorname{argmax}}\left(\frac{\min_m W^T|U - e^m| - \max_n W^T|U - u^n|}{\min_m W^T|U - e^m|}\right) \quad \text{Equation (6)}$$

initialized with $$U = \frac{1}{N}\sum_n u^n \text{ and} \quad \text{Equation (7)}$$

$$W = \frac{1}{\sigma(u^n)} \text{ and}$$

$$\hat{W} = \underset{W}{\operatorname{argmax}}\left(\frac{\min_m W^T|U - e^m| - \max_n W^T|U - u^n|}{\min_m W^T|U - e^m|}\right)$$

initialized with U=$\hat{U}$ and $$W = \frac{1}{\sigma(u^n)}$$

This optimization of the fingerprint and weight vectors enhances the robustness of the detection method according to the invention by lowering the false detection rate while maintaining an adequate detection rate.

To further improve the efficacy of the fire shot event detection method according to the present invention, additional method steps can be introduced to improve the ability of discriminating false fire shot events. For example, measured signals can be excluded from the comparison procedure based on their amplitudes. If the amplitude of the measured signal exceeds a predetermined upper bound or falls below a predetermined lower bound, the signal is zeroed. By adding such a lower and higher bound, the false detection rate of the detection method is additionally improved.

Although a preferred way of carrying out the comparison between a measurement signal and the predefined time-domain signature or fingerprint has been described above, the present invention is not limited to any particular way of doing so. A person skilled in the art would appreciate that there are numerous ways of establishing a correspondence between two different signals. For example, other mathematical comparison algorithms than those described above may be employed, or image recognition techniques may be used to compare the curves representing the measurement signal and the fingerprint signal.

As aforementioned, the principle for detecting a fire shot event described above is not limited to the use of any particular physical quantity but is applicable to any physical quantity whose magnitude changes in time as a result of a fire shot event in a weapon.

For example, the pressure wave in air may be utilized, in which case the measuring means of the shot detection device is a pressure sensor arranged to measure the pressure variations in time caused by the explosion of a cartridge in the firearm. Since pressure changes may occur even though the firearm with which the shot detection device is associated is not fired, e.g. due to a fire shot event in a neighbouring weapon, a fire shot event detection principle based on a threshold value for the measured pressure would result in high false detection rate. By comparing the measured pressure variation with a predetermined pressure fingerprint, the detection principle according to the present invention is able to distinguish "true" fire shot events from "false" fire shot events, thus severely reducing the false detection rate.

Another physical quantity that may be utilized according to the invention is the electromagnetic wave or pulse caused by the explosion of a cartridge in the weapon used. The shock-wave energy from the explosion of the cartridge produces a lot of charged high-velocity particles leaving the weapon which, when decelerating, emit electromagnetic waves or pulses. These electromagnetic pulses may be registered by an antenna functioning as the measuring means of the shot detection device and the time-pattern of the received antenna signal may in turn be compared to an electromagnetic fingerprint in order to detect the fire shot event.

Yet another physical quantity that may be utilized when using flame-generating ammunition is the radiance or light intensity of the weapon's muzzle flash caused by the explosion of a cartridge. The radiance or light intensity may be measured by an infrared sensor and the variation of the radiance or light intensity over time can be compared to a radiance or light intensity fingerprint in order to determine whether the weapon really has been fired.

Furthermore it should be added that different weapon types normally have different signatures or fingerprints for the same physical quantity, i.e. the change of a particular physical quantity in time may vary from a fire shot event in, e.g., a M16 firearm and a M249 firearm. A shot detection device, such as the shot detection device 3 described with reference to FIG. 1 may therefore be arranged to store multiple fingerprints relating to different weapon types. The shot detection device 3 and the weapon 1 may comprise identification means in order for the shot detection device 3 to identify the weapon type to which it is currently attached, and chose the proper fingerprint for the comparison procedure accordingly. Identification may be performed through direct communication between the shot detection device 3 and the weapon 1, or through communication via an information collection device carried by the user of the weapon.

It should also be appreciated that the fire shot event detection principle according to the invention is not limited to firearm weapons, i.e. weapons from which a shot is discharged by gunpowder. The principles of analyzing the acceleration of the weapon or the pressure wave in air, which acceleration and pressure wave above have been presumed to originate from the explosion of a cartridge, may also be used for carbon-dioxide powered weapons or pneumatic air weapons. Nor is the detection principle according to the invention limited to real weapons actually discharging some kind of projectile.

The principle is equally applicable to imitation or bully weapons particularly developed for laser-based shooting training or laser-based shooting games. In this case, the acceleration of the bully weapon or the sound caused by, e.g., a striker hitting a striker receiving portion within the bully weapon when said bully weapon being triggered by a user may be measured and analyzed by a shot detection device in the way described above.

Although depicted as an external device, the shot detection device 3 or the functionality thereof, which functionality above has been explained with reference to separate units 7, 9, 10 and 11 for the sake of simplicity, may as well be integrated in the weapon whose fire shot events it is intended to detect. This applies especially to imitation or bully weapons. It may, of course, also be possible to integrate parts of the functionality of the shot detection device 3 in the weapon. For example, the laser beam generating unit 10, the measuring means 7 and the comparison means 9 may be integral parts of the firearm while the communication means 11 may be detachably connected to the firearm in a way that allows it to receive information from the comparison means 9 and wirelessly transmit the information, e.g. by means of a radio link, to an information collection device.

The detailed disclosure of the invention given herein is only illustrative and exemplary and merely serves the purpose of providing a full and enabling disclosure thereof Accordingly, it is intended that the invention should be limited only by the scope of the claims appended hereinafter.

The invention claimed is:

1. A method for detecting a fire shot event in a weapon, the method comprising:

measuring with a measuring device a shock or vibration of the weapon whose magnitude changes in time as a result of a fire shot event so as to obtain a measurement signal, and comparing the measurement signal with a predetermined time-domain fingerprint for said shock or vibration of the weapon, which fingerprint is characteristic of a way said shock or vibration of the weapon varies in time upon a fire shot event, in order to confirm an occurrence of a fire shot event in case said measurement signal and said fingerprint match, wherein the measurement signal and the predetermined fingerprint signal are represented by vectors, and the comparison is based on a difference between said vectors.

2. The method according to claim 1, further comprising:

generating a laser beam emulating a fire shot from said weapon in case the occurrence of a fire shot event is confirmed.

3. A method for detecting a fire shot event in a weapon, the method comprising:

measuring with a measuring device a shock or vibration of the weapon whose magnitude changes in time as a result of a fire shot event so as to obtain a measurement signal, and comparing the measurement signal with a predetermined time-domain fingerprint for said shock or vibration of the weapon, which fingerprint is characteristic of a way said shock or vibration of the weapon varies in time upon a fire shot event, in order to confirm an occurrence of a fire shot event in case said measurement signal and said fingerprint match, wherein comparing the measurement signal with the predetermined fingerprint comprises:

forming an error estimation E as a weighted sum of absolute differences according to $E=W^T|U-s|$, where W is a weight vector, U is a vector representation of the predetermined fingerprint and s is a vector representation of the measurement signal; and computing E continuously with an online algorithm where the computation is made on a moving window of the same length as the fingerprint vector U in order to confirm the occurrence of a fire shot event in case E drops below a predetermined threshold value T.

4. The method according to claim 3, wherein the predetermined fingerprint vector U is determined as a mean of a plurality of fingerprint measurements according to $$U = \frac{1}{N}\sum_n u^n$$

$$n = 1 \ldots N$$

where $u^n$ is an $n^{th}$ fingerprint measurement vector and N is a number of fingerprint measurements.

5. The method according to claim 3, wherein the weight vector W is approximated as $$W = \frac{1}{\sigma(u^n)}$$

$$n = 1 \ldots N$$

where $u^n$ is an $n^{th}$ fingerprint measurement vector, N is a number of fingerprint measurements, and $\sigma(u^n)$ is a standard deviation for the fingerprint measurements.

6. A shot detection device for detecting a fire shot event in a weapon, said shot detection device comprising:

a measuring module configured to measure a shock or vibration of the weapon whose magnitude changes in time as a result of a fire shot event in said weapon, a comparison module configured to compare the shock or vibration measured by the measuring module to a predetermined time-domain fingerprint for said shock or vibration of the weapon, wherein the fingerprint is characteristic of a way said shock or vibration of the weapon varies in time upon a fire shot event, and arranged to confirm an occurrence of a fire shot event in case said measurement signal and said fingerprint match, and an identification module configured to identify a type of firearm to which the device is connected, said shot detection device further being arranged to store a plurality of fingerprints associated with different firearm types and to chose a fingerprint based on the type of firearm identified, and to compare the measurement signal to said chosen fingerprint, wherein said shot detection device is a separate unit which is arranged to be detachably connected to a firearm or is an integral part of a firearm, wherein the firearm can be real or imitation.

7. The shot detection device according to claim 6, further comprising:

a laser generator configured to generate a laser beam emulating a fire shot from said weapon in case said comparison module has confirmed the occurrence of a fire shot event.

8. The shot detection device according to claim 6, further comprising:

a transmitter configured to transmit information relating to the comparison procedure to an information collection device carried by the user of said weapon.

9. A computer program product stored on a non-transitory medium for detecting a fire shot event in a weapon, wherein said computer program, when executed by a processor in a shot detection device comprising a measuring module configured to measure a shock or vibration of the weapon whose magnitude changes in time as a result of a fire shot event in said weapon, a comparison module configured to compare the shock or vibration measured by the measuring module to a predetermined time-domain fingerprint for said shock or vibration of the weapon, wherein the fingerprint is characteristic of a way said shock or vibration of the weapon varies in time upon a fire shot event, and arranged to confirm an occurrence of a fire shot event in case said measurement signal and said fingerprint match, and an identification module configured to identify a type of firearm to which the device is connected, said shot detection device further being arranged to store a plurality of fingerprints associated with different firearm types and to chose a fingerprint based on the type of firearm identified, and to compare the measurement signal to said chosen fingerprint, wherein said shot detection device is a separate unit which is arranged to be detachably connected to a firearm, and wherein the computer program product is arranged to carry out a method comprising measuring a shock or vibration of the weapon whose magnitude changes in time as a result of a fire shot event so as to obtain a measurement signal, and comparing said measurement signal to a predetermined time-domain fingerprint, which fingerprint is characteristic of the way said shock or vibration of the weapon varies in time upon a fire shot event in order to confirm an occurrence of a fire shot event in case said measurement signal and said fingerprint match, and generate an output being indicative of whether said measurement signal and said fingerprint match, wherein the measurement signal and the predetermined fingerprint signal are represented by vectors, and the comparison is based on a difference between said vectors.

* * * * *

UNITED STATES PATENT AND TRADEMARK OFFICE

CERTIFICATE OF CORRECTION

PATENT NO. : 8,616,882 B2
APPLICATION NO. : 12/673597
DATED : December 31, 2013
INVENTOR(S) : Chedid et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 867 days.

Signed and Sealed this
Twenty-sixth Day of August, 2014

Michelle K. Lee

Michelle K. Lee
*Deputy Director of the United States Patent and Trademark Office*